US007051718B2

(12) United States Patent
Tsuruta et al.

(10) Patent No.: US 7,051,718 B2
(45) Date of Patent: May 30, 2006

(54) FUEL VAPOR LEAK CHECK MODULE

(75) Inventors: Masafumi Tsuruta, Handa (JP); Masao Kano, Gamagori (JP)

(73) Assignee: Denso Corporation (JP)

( * ) Notice: Subject to any disclaimer, the term of this patent is extended or adjusted under 35 U.S.C. 154(b) by 33 days.

(21) Appl. No.: 10/923,005

(22) Filed: Aug. 23, 2004

(65) Prior Publication Data

US 2005/0044938 A1 Mar. 3, 2005

(30) Foreign Application Priority Data

Aug. 25, 2003 (JP) ..... 2003-300155

(51) Int. Cl.
*F02M 33/02* (2006.01)

(52) U.S. Cl. ..... 123/519; 123/520; 123/198 D

(58) Field of Classification Search ..... 123/516, 123/518–520, 198 D; 73/40, 49.7, 116, 117, 73/117.2, 117.3, 118
See application file for complete search history.

(56) References Cited

U.S. PATENT DOCUMENTS 5,967,124 A * 10/1999 Cook et al. ..... 123/520
6,550,315 B1 * 4/2003 Streib ..... 73/49.7
6,722,348 B1 * 4/2004 Nagasaki et al. ..... 123/520
6,820,467 B1 * 11/2004 Streib ..... 73/49.2
6,834,535 B1 * 12/2004 Kano et al. ..... 73/49.7
6,848,298 B1 * 2/2005 Miyahara et al. ..... 73/49.2
6,889,667 B1 * 5/2005 Fritz et al. ..... 123/520
6,959,587 B1 * 11/2005 Schulz et al. ..... 73/49.7
6,964,193 B1 * 11/2005 Kobayashi et al. ..... 73/118.1

OTHER PUBLICATIONS

U.S. Appl. No. 10/911,555, filed Aug. 2004, Kobayashi et al.
U.S. Appl. No. 10/923,786, filed Aug. 2004, Kano et al.
U.S. Appl. No. 10/923,774, filed Aug. 2004, Kobayashi et al.
U.S. Appl. No. 10/922,999, filed Aug. 2004, Kobayashi et al.

* cited by examiner

*Primary Examiner*—Thomas Moulis
(74) *Attorney, Agent, or Firm*—Nixon & Vanderhye PC

(57) ABSTRACT

A housing of a fuel vapor leak check module is arranged close to a canister by inserting a canister port into the canister. A distance between the canister and the leak check module is reduced. A centerline of the canister port is approximately parallel to a centerline of an atmospheric vent port. A brushless motor of which axial length is relatively short drives a pump so that the housing is formed stepwise at the side opposite to the canister. A connector is disposed on the housing accommodating the pump to reduce a dead space.

5 Claims, 3 Drawing Sheets

FUEL VAPOR LEAK CHECK MODULE

CROSS REFERENCE TO RELATED APPLICATION

This application is based on Japanese Patent Application No. 2003-300155 filed on Aug. 25, 2003, the disclosure of which is incorporated herein by reference.

FIELD OF THE INVENTION

The present invention relates to a fuel vapor leak check module, which detects leakage of fuel vapor generated in a fuel tank.

BACKGROUND OF THE INVENTION

In view of protecting the environment, fuel vapor has been controlled besides the exhaust emission control. According to the regulation established by the Environmental Protection Agency (EPA) and the California Air Resourced Board (CARB), a leak detection of the fuel vapor from a fuel tank is required.

A conventional leak check module for fuel vapor has a pump generating pressure gradient between an inside and an outside of the fuel tank, and a motor driving the pump. The fuel vapor leak check module, which is referred to as the leak check module, has a canister port which connects to the fuel tank through a vapor storage canister and an atmospheric vent port which communicates with the atmosphere. A switching valve connects the pump alternatively with the canister port and the atmospheric vent port, by which the fuel vapor leak check is conducted.

However, in the conventional leak check module, the centerline of the canister port is orthogonal to the centerline of the atmospheric vent port. When the canister port and the atmospheric vent port are opened parallel in the leak check module, the conduits connected with these ports are bended at middle or the other end thereof. Thus, a large space is necessary to provide the leak check module and the like on a vehicle. Furthermore, the leak check module on the vehicle is connected with the canister through a conduit which requires a space.

On the other hand, the leak check module is disposed at the vicinity of the fuel tank for detecting the fuel vapor leaking from the fuel tank so that the vicinity space of the fuel tank is restricted. As the result, when a lager space is reserved for the leak check module, the configuration of the vehicle may be changed, for example, the fuel tank may be downsized.

SUMMARY OF THE INVENTION

An object of the present invention is to provide a fuel vapor leak check module which requires less space than the conventional module.

According to the present invention, an atmospheric vent port and a canister port are formed in such a manner that each of the centerline thereof is parallel to one another and extends in the opposite direction. Furthermore, one end of the canister port of the leak check module is inserted into the canister. Thus, the entire length of the canister port is shortened to reduce a dead-space between the canister and the housing of the leak check module. Another passage is not needed between the canister and the housing so that a connecting portion is reduced to avoid the fuel vapor leakage.

When the pipe (not shown) is inserted into the atmospheric vent port 150, the inserting direction thereof is parallel to the direction of the canister port 140. Thus, inserting force of the pipe is added to the canister port 142 to be inserted into the canister 30, whereby the fuel vapor leakage at the connecting portion is reduced.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENT

Figure 2:
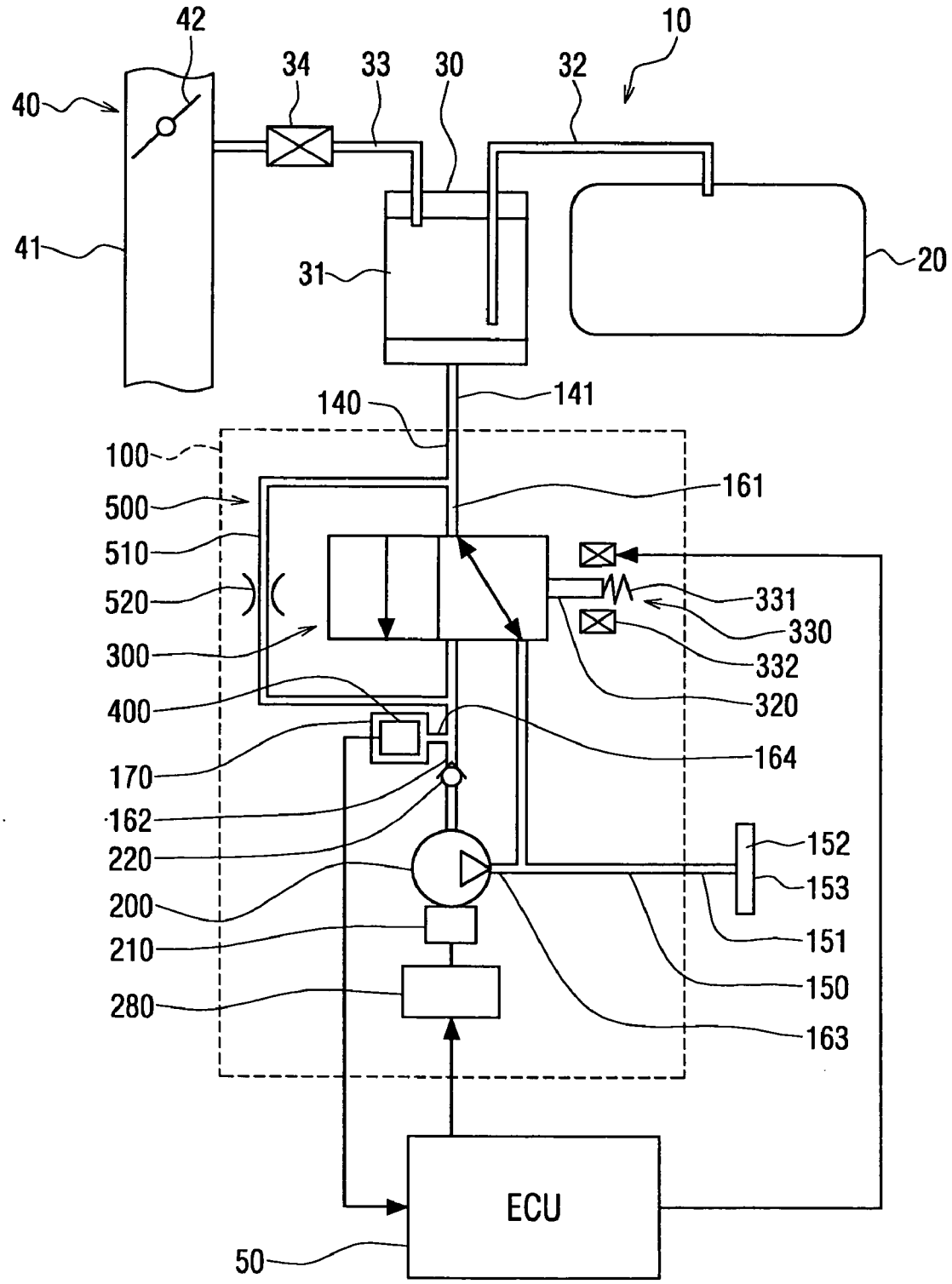
FIG. 2 is a schematic view of the leak check system to which the leak check module is applied.

FIG. 2 shows a fuel vapor leak check system to which a fuel vapor leak check module is applied. The fuel vapor leak check system is referred to as the leak check system.

Figure 1:
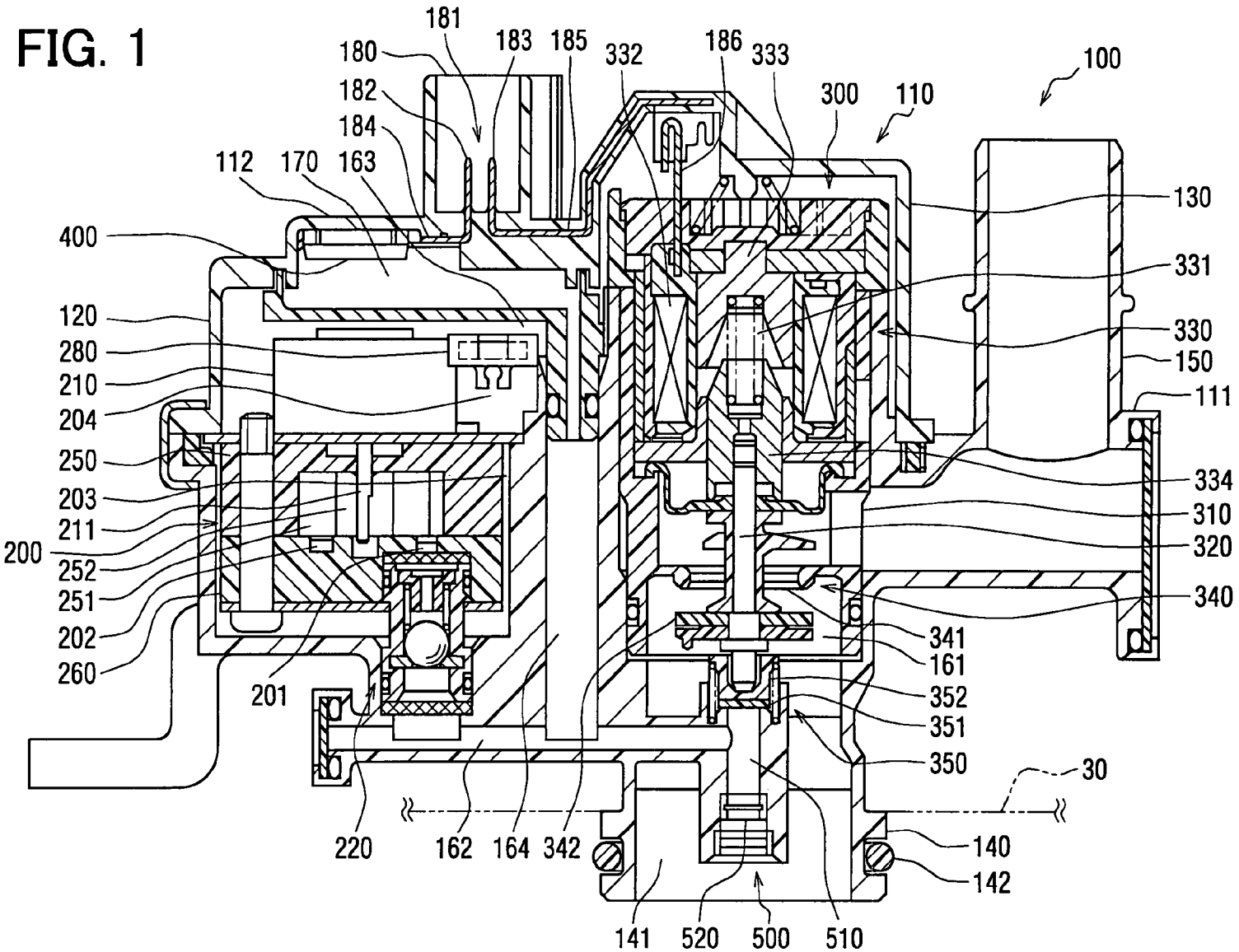
FIG. 1 is a cross sectional view of the leak check module according to the present invention.

The leak check module system 10 includes the leak check module 100, a fuel tank 20, a canister 30, an intake device 40, and ECU 50. As shown in FIG. 1, the leak check module 100 is provided with a housing 110, a pump 200, brushless motor 210, a switching valve 300, and a pressure sensor 400. The leak check module 100 is disposed above the fuel tank 20 and the canister 30 to prevent a flow of a liquid fuel or other liquid.

The housing 110 comprises a housing body 111 and a housing cover 112. The housing 110 accommodates the pump 200, the brushless motor 210, and the switching valve 300. The housing 110 includes a pump accommodating space 120 and a valve accommodating space 130. The pump 200 and the brushless motor 210 are disposed in the pump accommodating space 120, and the switching valve 300 is disposed in the valve accommodating space 120. The housing body 111 is provided with a canister port 140 and an atmospheric vent port 150. The canister port 140 communicates with the canister 30 through a canister passage 141. The atmospheric vent port 150 communicates with an atmospheric passage 151 having an open end 153 at which an air filter 152 is disposed. The atmospheric passage 151 communicates with ambient air. The housing body 111 can be made with the housing of the canister 30 integrally.

As shown in FIG. 1, the housing 110 has a connecting passage 161, a pump passage 162, a discharge passage 163, a pressure introducing passage 164, and a sensor room 170. The connecting passage 161 connects the canister port 140 with the atmospheric vent port 150. The pump passage 162 connects the connecting passage 161 with an inlet port 201 of the pump 200. The discharge passage 163 connects the outlet port 202 of the pump 200 to the atmospheric vent port 150. The pressure introducing passage 164 is branched from the pump passage 162 and connects the pump passage 162 and the sensor room 170. Since the sensor room 170 communicates with the pressure introducing passage 164, the inner pressure of the sensor room 170 is almost the same as the pressure in the pump passage 162.

The discharge passage 163 is formed between the housing 110 and the pump 200, the brushless motor 210 in the pump accommodating space 120 and is formed between the housing 110 and the switching valve 300 in the valve accommodating space 130. An air discharged from the outlet port 202 of the pump flows into a clearance (not shown) between the switching valve 300 and the housing 110 through a clearance 203 between the pump 200 and the housing 110 and a clearance 204 between the brushless motor 210 and the housing 110. The air flowing into the clearance between the switching valve 300 and the housing 110 flows into the atmospheric vent port 150 along the clearance.

The housing 100 has an orifice portion 500 at the side of the canister port 140. The orifice portion 500 has an orifice passage 510 which branches from the canister passage 141. The orifice passage 510 connects the canister port 140 with the pump passage 162 and has an orifice 520 therein. The orifice 520 corresponds to the size of an opening for which leakage of fuel vapor is acceptable. For example, the CARB and EPA regulations provide for accuracy of detecting leakage of fuel vapor from fuel tank 20. The regulations require that fuel vapor leakage through an opening equivalent to $\phi$0.5 mm should be detected. In the present embodiment, the orifice 520 has a diameter of 0.5 mm or less. The orifice passage 510 is formed at the inside of the canister port 140 to form a double cylinder by which the connecting passage 161 is formed outside and the orifice passage 510 is formed inside.

The pump 200 having an inlet port 201 and the outlet port 202 is provided in the pump accommodating space 120. The inlet port 201 is exposed to the pump passage 162 and the outlet port is exposed in the discharge passage 163. A check valve 220 is disposed at the vicinity of the inlet port 201 of the pump 200. When the pump is driven, the check valve 220 is opened. When the pump is not driven, the check valve is closed to restrict the flowing of air-mixed fuel into the pump 200.

The pump 200 is provided with a pump housing 250, a pump case 260, and a rotor 252 rotating in the pump housing 250. The rotor 253 has a vane which is slidable in the radial direction and slides on the inner surface of the pump housing 250 while the rotor is rotating. By rotating the rotor 252, the air introduced from the inlet port 201 is discharged to the outlet port 202. The pump 200 functions as a suction pump to reduce the pressure in the fuel tank 20 through the canister 30.

Then pump 200 is provided with a brushless motor 210 of which shaft 211 is provided with the rotor 252 having the vane 251. That is, the brushless motor 210 drive the pump 200. The brushless motor 210 is a DC motor which has no electric contact point and rotates the rotor, which is not shown, by changing a current applying position to a coil. The brushless motor is electrically connected to a control circuit 280 which controls the brushless motor 210 in a constant speed. The control circuit 280 is disposed in a clearance which forms the discharge passage 163. The control circuit 280 includes an electronic part generating heat such as a Zener diode. By disposing the control circuit 280 in the clearance 204 comprising the discharge passage 163, the control circuit 280 is cooled by air discharged from the pump 200.

The switching valve 300 includes a valve body 310, a valve shaft 320, and a solenoid actuator 330. The valve body 310 is disposed in the valve accommodating space 130. The switching valve 300 includes an opening-closing valve 340 and a reference valve 350. The opening-closing valve 340 includes a first valve sheet 341 and a washer 342 which is provided on the valve shaft 320. The reference valve 350 includes a second valve sheet 351 formed on the housing 110 and a valve cap 352 fixed on one end of the valve shaft 320.

The valve shaft 320 is actuated by the solenoid actuator 330 and has the washer 342 and valve cap 352. The solenoid actuator 330 has a spring 331 biasing the valve shaft 320 toward the second valve sheet 351. The solenoid actuator 330 has a coil 332 which is connected to the ECU 50. The ECU 50 controls an electric supply to the coil 332. When the electric current is not supplied to the coil 332, no attracting force is generated between a fixed core 333 and a movable core 334. Thus, the valve shaft 320 fixed to the movable sore 334 moves down in FIG. 1 by biasing force of the spring 331 so that the valve cap 352 closes the second valve sheet 351. Thereby, the connecting passage 161 is disconnected from the pump passage 162. The washer 342 opens the first valve sheet 341 to communicate the canister port 140 to the atmospheric vent port 150 through the connecting passage 161. Therefore, when the electric current is not supplied to the coil 332, the canister port 140 is disconnected from the pump passage 162 and the canister port 140 is communicated to the atmospheric vent port 150.

When the electric current is supplied to the coil 332 according to the signal from the ECU 40, the fixed core 334 attracts the movable core 333. The valve shaft 320 connected with the movable core 334 moves up against the biasing force of the spring 331. The valve cap 352 opens the second valve sheet 351 and the washer 342 close the first valve sheet 341 whereby the connecting passage 161 communicates the pump passage 162. Therefore, when the coil is energized, the canister port 140 communicates with the pump passage 162 and the canister port 140 disconnects from the atmospheric vent port. The orifice passage 510 always communicates with the pump passage 162, regardless of whether the coil 332 is energized.

The canister 30 has therein a fuel vapor adsorbent material 31 such as activated carbon granules, which adsorbs fuel vapor generated in the fuel tank 20. The canister 30 is disposed between the leak check module 100 and the fuel tank 20. The canister passage 141 connects the canister 30 with the leak check module 100 and a tank passage connects the canister 30 with the fuel tank 20. A purge passage 33 connects the canister 31 to an intake pipe 41 of the intake device 40. The fuel vapor generated in the fuel tank 20 is adsorbed by the adsorbent material 31 while flowing through the canister 30. The fuel concentration in the air flowing out from the canister 30 is less than a predetermined value. The intake pipe 31 has a throttle valve 42 therein which controls air amount flowing in the intake pipe 31. The purge passage 33 has a purge valve 34 which opens and closes the purge passage 33 according to the signal from the ECU 50

The pressure sensor 400 is disposed in the sensor room 170. The pressure sensor 400 detects the pressure in the sensor room 170 and outputs signals to the ECU 170 according to the detected pressure. The sensor room 170 communicates with the pump passage 162 through the pressure introducing passage 164. Thus, the pressure in the sensor room 170 is substantially equal to the pressure in the pump passage 162. The pressure sensor 400 is disposed far from the pump 200 by which pressure fluctuation caused by the pump 200 is more reduced than the case in which the pressure sensor 400 is disposed close to the inlet port 201 of the pump 200. Therefore, the pressure sensor 400 detects the pressure in the sensor room 170 more precisely.

The ECU 50 is comprised of microcomputer which has CPU, ROM, and RAM (not shown) and controls the leak check module 100 and other components on the vehicle. The ECU 50 receives multiple signals from sensors to execute control programs memorized in ROM. The brushless motor 210 and the switching valve 300 are also controlled by the ECU 50.

The construction of the housing 110 of the leak check module 100 is described herein after.

The canister port 140 provided on the housing 110 has a centerline which is substantially parallel to a centerline of the atmospheric vent port 150. The canister port 140 and the atmospheric vent port 150 are connected with each other through the connecting passage 161. The atmospheric port 150 extends in the opposite direction of the canister passage relative to the housing 110. The canister 30, the canister port 140, and the atmospheric vent port 150 are arranged substantially on the same line. This arrangement reduces a space which is required for the canister passage 141 and the atmospheric passage 151. As the result, a mountability of the leak check module is improved even if the space around the fuel tank 20 is restricted.

The housing 110 has a side confronting to the canister 30, the side being substantially flat except the canister port 140. A protruding portion of the canister port 140 is inserted into the canister 30 as shown in FIG. 1. The outer surface of the canister port 140 and the inner surface of the canister 30 are sealed by O-ring. The housing 110 is close to the canister 30 so that the entire length of the canister passage 141 is reduced. Furthermore, the dead space between the leak check module 100 and the canister 30 is reduced, and the space required by the leak check module 100 and the canister 30 is also reduced.

The housing 110 has a side surface opposite to the canister 30, the side surface being formed stepwise in such a manner that the valve accommodating space 130 protrudes than the pump accommodating space 120. That is, the housing cover 112 is formed stepwise between pump accommodating space 120 and the valve accommodating space 130.

The brushless motor 210 has shorter length in the axial direction than the conventional DC motor. Thus, by providing the brushless motor 210 as a power source of the pump 200, the axial length of the pump accommodating space 120 is reduced.

As the result, the design flexibility of the housing 110 is improved so that the one side of the housing 110 can be almost flat while confronting the canister 30.

A connector 180 is provided on the housing cover 112 at the place confronting the pump accommodating space 120. The connector 180 has a group of terminals 181 which is connected with a coupler (not shown) to which electrical current is supplied through the ECU 50. The group of terminals 181 includes a terminal 182 connected with the pressure sensor 400 through a lead 184, and a terminal 183 connected with the coil 332 of the switching valve 300 through a lead 185, 186. The group of the terminals 181 also includes a terminal (not shown) connected with the control circuit 280 of the brushless motor 210. The terminals 182, 183 and the leads 184, 185, 186, which comprise a group of terminals 181, are molded by resign to a first mold. The housing cover 112 is formed by molding with inserting the first mold therein.

Since the connector 180 is disposed on the housing cover 112 at the side of pump accommodating space 120, the end of the connector 180 and the end surface of the housing cover 112 at the side of the valve accommodating space 130 are substantially on the same plane. Thus, a dead space at side of the housing cover 112 is reduced. When the leak check module 100 is assembled on the vehicle, the connector 180 does not interfere with other components to avoid the damages of the connector 180 and the group of the terminal 181.

The operation of the leak check module 100 is described herein after.

When a predetermined period elapses after the engine is turned off, the fuel vapor leak check is conducted. The predetermined period is set to stabilize the vehicle temperature. While the engine is running and until the predetermined period elapses, the fuel vapor leak check by the leak check module 100 is not conducted. The coil 332 is not energized, and the canister port 140 and the atmospheric vent port 150 are connected with each other through the connecting passage 161. The fuel vapor fraction of the fuel vapor/air mixture adsorbs in the canister 30. Then, the air fraction is expelled from the opening end 153 of the atmospheric passage 151. At this moment, the check valve 220 is closed, air including fuel vapor generated in the fuel tank 20 is prevented from flowing into the pump 200.

(1) When the predetermined period elapses after the engine is turned off, an atmospheric pressure is detected prior to the fuel vapor leak check. That is, since the fuel vapor leak check is conducted based on the pressure change with the pressure sensor 400, it is necessary to reduce an atmospheric effect due to altitude. When the coil 332 is not energized, the atmospheric vent port 150 communicates with the pump passage 162 through the orifice passage 510. Since the sensor room 170 communicates with the pump passage 162 through the pressure introducing passage 164, the pressure in the sensor room 170 is substantially equal to the atmospheric pressure. The atmospheric pressure detected by the pressure sensor 400 is converted to a pressure signal, the pressure signal being output to the ECU 50. The pressure signal from the pressure sensor 400 is of a ratio of voltage, a duty ratio, or bit output. Thus, the noise effect generated by the solenoid actuator 330 or other electric actuators can be reduced to maintain the detection accuracy of the pressure. At this moment, only the pressure sensor 400 is turned on and the brushless motor 210 and the switching valve 300 are turned off. This state is indicated as an atmospheric pressure detection period A in FIG. 3. The pressure detected in the sensor room 170 is equal to the atmospheric pressure.

(2) After the atmospheric pressure is detected, the altitude at which the vehicle is parked is calculated according to the detected atmospheric pressure. For example, the altitude is calculated based on a map showing a relationship between the atmospheric pressure and the altitude, which is memorized in ROM of the ECU 50. The other parameters are corrected according to the calculated altitude. The calculation and the correction above are executed by ECU 50.

Figure 3:
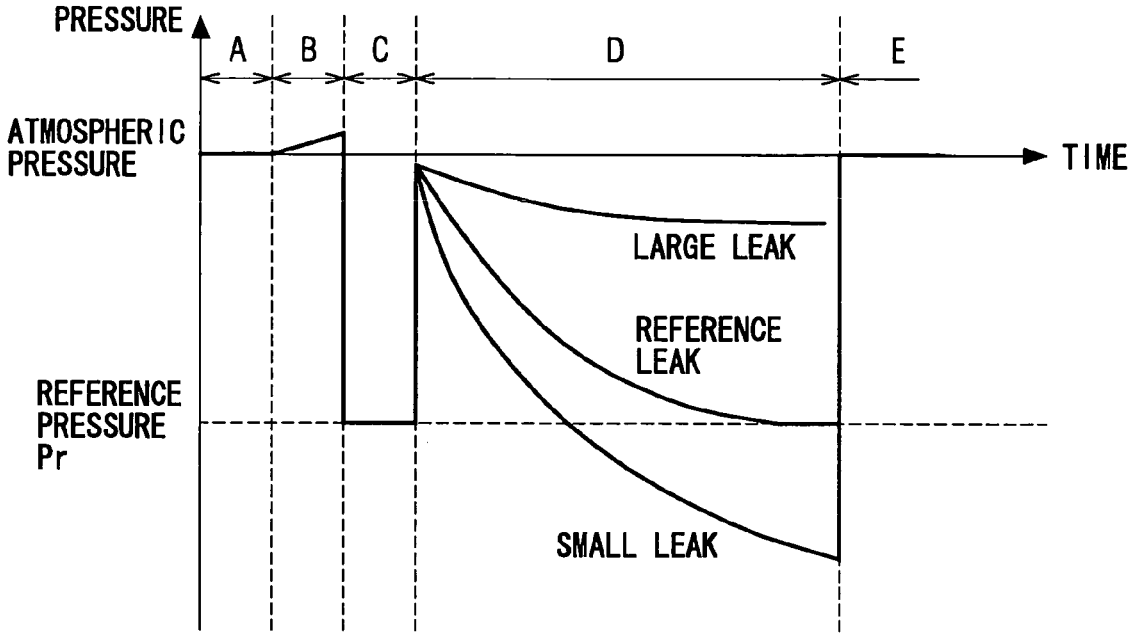
FIG. 3 is a graph showing a pressure change detected by a pressure sensor of the leak check module.

After the correction of parameters is executed, the coil 332 of the switching valve 300 is energized of which state is indicated as a fuel vapor detection period B in FIG. 3. Since the coil 332 is energized, the fixed core 333 attracts the movable core 334 so that the washer 342 closes the first valve sheet 341 and the valve cap 352 opens the second valve sheet 351. The atmospheric vent port 150 disconnects from the pump passage 162, and the canister port 140 connects to the pump passage 162. As a result, the sensor room 170 connected to the pump passage 162 is connected with the fuel tank 20 through the canister 30. The pressure in the fuel tank 20 is larger than the ambient pressure due to the fuel vapor. The pressure detected by the pressure sensor 400 is slightly larger than the atmospheric pressure as shown in FIG. 3.

(3) When the pressure increase in the fuel tank 20 is detected, the coil 332 of the switching valve 300 is deenergized. This state is indicated as a reference detection range C in FIG. 3. The moving core 334 and the valve shaft 320 move in biasing direction of the spring 331 so that the washer 342 opens the first valve sheet 341 and the valve cap 352 closes the second valve sheet 351. The pump passage 162 communicates with the canister port 140 and the atmospheric vent port 150 through the orifice passage 510. The canister port 140 communicates with the atmospheric vent port 150 through the connecting passage 161.

When the brushless motor 210 is energized, the pump 200 is driven to reduce the pressure in the pump passage 162 so that the check valve 220 is opened. The air flowing into the canister port 140 from atmospheric vent port 150 and air/fuel mixture flowing from the canister port 140 flow into the pump passage 162 through the orifice passage 510. Since the air flowing into the pump passage 162 is restricted by the orifice 520 in the orifice passage 510, the pressure in the pump passage 162 is decreased as shown in FIG. 3. Since the orifice 520 has a constant aperture, the pressure in the pump passage 162 is decreased to a reference pressure Pr, which is memorized in RAM of the ECU 50. After the reference pressure Pr is detected, the brushless motor 210 is deenergized.

(4) When the detection of reference pressure is finished, the coil 322 of the switching valve 300 is energized again. The washer 342 closes the first valve seat 341 and the valve cap 352 opens the second valve sheet 351 so that the canister port 140 communicates with the pump passage 162. That is, the fuel tank 20 communicates with the pump passage 162 so that the pressure in the pump passage 162 becomes equal to the pressure in the fuel tank 20. The pressure in the fuel tank 20 is almost the atmospheric pressure. The brushless motor 210 is energized again to drive the pump and to open the check valve 220 so that the pressure in the fuel tank 20 decreases. The pressure in the sensor room 170, which is detected by the pressure sensor 400, decreases gradually. This state is illustrated as decompression range D in FIG. 3.

While the pump 200 is operated, when the pressure in the sensor room 170, which is equal to the pressure in the fuel tank 20, becomes under the reference pressure Pr, it is determined that the amount of fuel vapor leakage is under the permissible value. In other words, no air is introduced into the fuel tank 20 from outside, or amount of air introducing into the fuel tank is less than the amount which is equivalent to the orifice leakage. Therefore, it is determined that the sealing of the fuel tank 20 is enough.

On the other hand, when the pressure in the fuel tank 20 does not decrease to the reference pressure Pr, it is determined that the amount of fuel vapor leakage is over the permissible value. It is likely that the outside air is introduced into the fuel tank 20 during the decompression. Therefore, it is determined that the sealing of the fuel tank 20 is not enough. In this case, it is likely that the fuel vapor in the fuel tank 20 escapes over the permissible value. When it is determined that impermissible amount of fuel vapor leakage exists, a warning lump on a dashboard (not shown) is turned on to notify the driver of fuel vapor leakage at a successive operation of the vehicle.

When the pressure in the fuel tank 20 is almost equal to the reference pressure Pr, it means that the fuel vapor leakage arises, the fuel vapor leakage being equivalent to the fuel vapor leakage through the orifice 520.

(5) When the detection of fuel vapor leakage is finished, the brushless motor 210 and the switching valve 300 are turned off. This state is illustrated as a range E in FIG. 3. In the ECU 50, it is confirmed that the pressure in the pump passage 162 is recovered to the atmospheric pressure as shown in FIG. 3. Then, the pressure sensor 400 is turned off to finish the all-detecting step.

In this embodiment, since the canister port 140 and the atmospheric vent port are substantially aligned, the passage from the canister port 140 to the atmospheric vent port is so simple that pressure loss in the passage is reduced. The fuel vapor leakage is detected by reducing the pressure in the fuel tank 20 so that fuel vapor does not flow out from the fuel tank 20 during the leakage detection. It is beneficial to the environments. Since the brushless motor 210 has no contact point, a fluctuation of the operation due to an abrasion of contacts is avoided. By using the pressure sensor 400, the pressure in the fuel tank 20 is precisely detected without respect to the altitude at the vehicle is parked so that a detection accuracy is enhanced and the leak check module 100 lasts longer than the conventional one.

In another embodiment, the leak check module can be applied to the leak check system in which the inside of the fuel tank is pressurized.

What is claimed is:

1. A fuel vapor leak check module comprising;

an evaporated fuel purge system including a fuel tank, a canister which connects to the fuel tank through a tank passage, and a purge valve connected to an intake system of an engine through a purge passage;

a pump pressurizing or depressurizing the interior of the evaporated fuel purge system;

a motor driving the pump;

a canister port communicating with the fuel tank through the canister which adsorbs a fuel vapor generated in the fuel tank;

an atmospheric vent port being substantially parallel to the canister port and extending to open in an opposite direction relative to the canister port, the atmospheric vent port having an end opened to atmosphere;

a switching valve selectively switching between a position in which the canister port is communicated with the atmospheric port and another position in which the canister port are communicated with the pump; and a housing having an accommodating space which accommodates the pump, an accommodating space which accommodates the switching valve, the canister port, and the atmospheric port, the canister port being inserted into the canister.

2. The fuel vapor leak check module for detecting a fuel vapor leakage from a fuel tank according to claim 1, wherein the housing has a flat surface confronting an opposite side of the canister with respect to the fuel tank.

3. A fuel vapor leak check module comprising;

an evaporated fuel purge system including a fuel tank, a canister which connects to the fuel tank through a tank passage, and a purge valve connected to an intake system of an engine through a purge passage;

a pump pressurizing or depressurizing the interior of the evaporated fuel purge system;

a motor driving the pump;

a canister port communicating with the fuel tank through a canister which adsorbs a fuel vapor generated in the fuel tank;

an atmospheric vent port having an end opened to atmosphere;

a switching valve selectively switching between a position in which the canister port is communicated with the atmospheric port and another position in which the canister port are communicated with the pump; and a housing having a pump accommodating space which accommodates the pump, a valve accommodating space which accommodates the switching valve, the canister port, and the atmospheric port, the canister port being inserted into the canister, wherein the housing is provided with a connector on an outer surface of the pump accommodating space at the opposite side of the canister, the connecter having terminals electrically connected to the motor and the switching valve.

4. The fuel vapor leak check module for detecting a fuel vapor leakage from a fuel tank according to claim 3, wherein the housing has a side surface opposite to the canister, the side surface being formed stepwise in such a manner that the valve accommodating space protrudes than the pump accommodating space, and the motor is a brushless motor.

5. The fuel vapor leak check module for detecting a fuel vapor leakage from a fuel tank according to claim 4, wherein a distance between the outer surface of the housing opposite to the canister and an end of the connecter opposite to the canister is approximately equal to a distance between the outer surface of the housing forming the pump accommodating space at the side opposite to the canister and the outer surface of the housing forming the valve accommodating space at the side opposite to the canister.

* * * * *